United States Patent [19]

McNutt

[11] Patent Number: 5,042,649

[45] Date of Patent: Aug. 27, 1991

[54] KEY CASE

[76] Inventor: Terry N. McNutt, 1385 Perez Crescent, Gloucester, Ontario K1J 8V3, Canada

[21] Appl. No.: 544,750

[22] Filed: Jun. 27, 1990

[51] Int. Cl.[5] ..... A45C 11/32

[52] U.S. Cl. ..... 206/38.1; 206/37.8; 150/900

[58] Field of Search ..... 206/37.1, 37.2, 37.3, 206/37.4, 37.5, 37.6, 37.7, 37.8, 38.1, 38; 150/900; 70/456 R

[56] References Cited

U.S. PATENT DOCUMENTS

| | | | |
|---|---|---|---|
| 804,545 | 11/1905 | Paine | 206/37.1 |
| 1,509,829 | 9/1924 | Doty | 206/37.1 |
| 1,715,348 | 6/1929 | Barbara | 206/37.3 |
| 2,479,524 | 8/1949 | Tarbox | 206/37.4 |
| 2,805,466 | 9/1957 | Martinuzzi | 70/456 R |
| 3,011,537 | 12/1961 | Castro | 206/37.8 |
| 3,016,940 | 1/1962 | Mullin | 206/37.3 |
| 3,119,429 | 1/1964 | Stiller et al. | 206/37.3 |
| 3,353,579 | 11/1967 | Bechter et al. | 206/37.1 |

FOREIGN PATENT DOCUMENTS

| | | | |
|---|---|---|---|
| 412623 | 7/1934 | United Kingdom | 206/37.2 |

*Primary Examiner*—Paul T. Sewell
*Assistant Examiner*—Jacob K. Ackun, Jr.
*Attorney, Agent, or Firm*—Eckert Seamans Cherin & Mellott

[57] ABSTRACT

A novel key case is provided herein. The key case comprises a sac formed of thin pliant, reversible material, e.g., a soft leather. The sac has a wide, open end and a narrow, closed end, and is preferably cone-shaped, and an elastic pressure foot formed by a resilient member, e.g. a flat, synthetic elastomeric fibre, sewn into a lower hem at the wide, open end of the sac, e.g. by a silk thread is provided at the open, wide, end of the sac. A fixed-length, non-extendible metal eyelet is provided at the closed, narrow, end of the sac, and a chain link is secured to the eyelet within the interior of the sac. Keys may be secured to the chain link, and may, at the will of the user, be disposed completely within the sac or exposed out of the sac, by turning the sac inside out.

9 Claims, 1 Drawing Sheet

KEY CASE

BACKGROUND OF THE INVENTION (i) Field of the Invention

This invention relates to key cases.

(ii) Description of the Prior Art

Cases to hold keys are old in the art. Many prior constructions of one-piece key cases and money purses have been provided which were formed from molded rubber-like material, e.g., rubber or one of the many plastics, all of which were relatively resilient. Furthermore, certain of these key cases and money purses have been constructed with openings which remained normally closed but which may be opened by applying pressure to certain portions thereof, whereas others have used various forms of metal or plastic fastening means. None of these prior constructions, however, have been completely satisfactory.

Those prior constructions of key cases and money purses formed principally of rubber-like materials and having various forms of metal fasteners were relatively expensive, in view of the costs of first providing the basic rubber-like material which would not, under relatively heavy abuse, tear loose from the rubber-like material, thereby destroying the entire usefulness of the construction.

Also, certain of the prior construction of unitary molded key cases formed from the rubber-like material were of improper contour in the area of the opening thereof, which prevented the opening in certain critical locations from being opened sufficiently to provide the convenient passage of keys therethrough.

As one example, U.S. Pat. No. 1,608,112 patented Nov. 23rd, 1926 by K. Muethel provided a simple, and economical key case. A spring member fitted within the case exerted pressure to cause the side walls approximately to contact one another whereby the keys were held within the case frictionally. The spring member was provided with a loop for slidably maintaining a plurality of keys. The keys automatically dropped out of the case when the case was contracted endwise to cause the side walls to expand and relieve the keys of the frictional grip. When it was desired to have access to the keys, the case, or open-mouthed pouch, was turned downwardly, and with one operation the end walls were compressed to expand the mouth of the pouch, whereby the keys dropped out and hung suspended by their retaining loop. In order to reencase the keys, it was necessary to turn the pouch right-side up and exert a slight pressure thereon, whereby the keys dropped automatically into the case and were gripped thereby.

Stiller U.S. Pat. No. 2,912,030, disclosed a key case with movement of the keys, as a unit, being controlled by a retaining strap that moved relatively of the carrying pouch between fully extended and partially extended condition, thus permitting the keys to be moved between the interior and the exterior of the carrying pouch for the same.

U.S. Pat. No. 3,016,940 patented Jan. 16th, 1962 by J. Mullen provided a key case construction formed of rubber-like resilient material, and including laterally spaced, generally longitudinally extending side portions, forward edge and bottom edge and rearward edge portions joining the side portions forming an upwardly opening pocket. An upper edge portion had a longitudinal opening formed therein extending the major portion of the longitudinal length of the upper edge portion. The opening had a normally resiliently closed line opening part. Key fastening means were operably connected to one of the portions adjacent the opening for securing keys movable between positions completely inward of the pocket and through the upper edge portion opening to completely outward of the pocket.

U.S Pat. No. 3,119,429 patented Jan. 28th, 1969 provided a key case comprising a unitary flexible open-end pouch formed of rubbery material and including substantially parallel flat wall surfaces that integrally merge with the edge walls of the pouch. At least one support shoulder was formed in the body portion of the pouch. Chain supporting means were supported interiorly of the pouch by the support shoulder. A key chain was provided having its ends connected to form an endless loop, the key chain being carried by the chain supporting means, and having a length sufficient to permit the chain to be extended in free condition through the open end to a position exteriorly of the pouch.

Thus, moving of the key cases of the prior art were of the type wherein keys as a group were selectively moved in and out of a carrying pouch for the same, with such movement being initiated upon the application of collapsing pressure against the edge portions of the key case. Other types of key cases were of the type comprising a unitary molded key case formed of rubber-like resilient material.

The art therefore has been concerned with providing a specifically improved contour providing distinct advantages and improved performance over key cases of this type heretofore known. The art has also been concerned with the problem that the longevity or useful life of such an item was predicated on the durability of a retaining strap. Since this strap was of necessity thin and was subjected to constant usage, it was found that it wore out prematurely, with the result that the key case was often discarded due to a broken strap when the remaining components of the pouch were perfectly serviceable for further use.

The art has found it to be desirable both from the costs and durability standpoint to provide such key cases and money purses formed as unitary moldings of the rubber-like material free from any metal fastening means. With such a construction, however, it was a problem to form the necessary opening therein so that it could be conveniently opened when desired, but would remain relatively tightly closed at other times.

SUMMARY OF THE INVENTION (i) Aims of the Invention

Yet, in spite of the above-described patents, the art has not been able to solve the problem above outlined. Accordingly, it is a general object of the present invention to provide a key case construction having opening means thereon which is easily opened.

It is another object of the present invention to provide a key case construction which solves the problems of the prior constructions discussed above, and specifically is formed in a manner such that the opening thereof may be easily and conveniently opened sufficient to permit the easy passage of keys therethrough, yet this opening will prevent the easy passage of keys in the normal position.

It is another object of the present invention to provide a key case construction which satisfies all of the above objects in a unique manner and which may be provided at a minimum of cost to the ultimate consumer.

(ii) Statement of Invention

By this invention, a key case is provided comprising: a) a sac formed of a thin pliant, reversible material; b) an elastic pressure foot at the open end of the sac; c) a metal-eyelet at the closed end of the sac formed by a resilient member sewn into a lower hem at the wide, open end of the sac; and d) a fixed length, non extendible chain link secured to the eyelet within the interior of the sac; whereby keys may be secured to the chain link, and may be disposed completely within the sac or exposed out of the sac by turning the sac inside out.

(iii) Other features of the Invention

The pressure foot preferably is formed of a flat, synthetic elastomeric fibre sewn into the lower hem by a silk thread. The key sac preferably is cone-shaped and is most preferably formed of a soft leather. The pressure foot is thus at the wide, open end of the cone, and the metal eyelet is thus at the closed, narrow end of the sac. The key sac preferably includes a clasp secured to the eyelet at the exterior of the sac. The pressure foot is preferably formed of a flat synthetic elastomeric fibre. The clasp is most preferably secured to the eyelet by means of a ring.

The key sac preferably includes a ring attached to the chain link, so that the keys may be secured tot he chain link.

BRIEF DESCRIPTION OF THE DRAWINGS

In the accompanying drawings.

Figure 1:
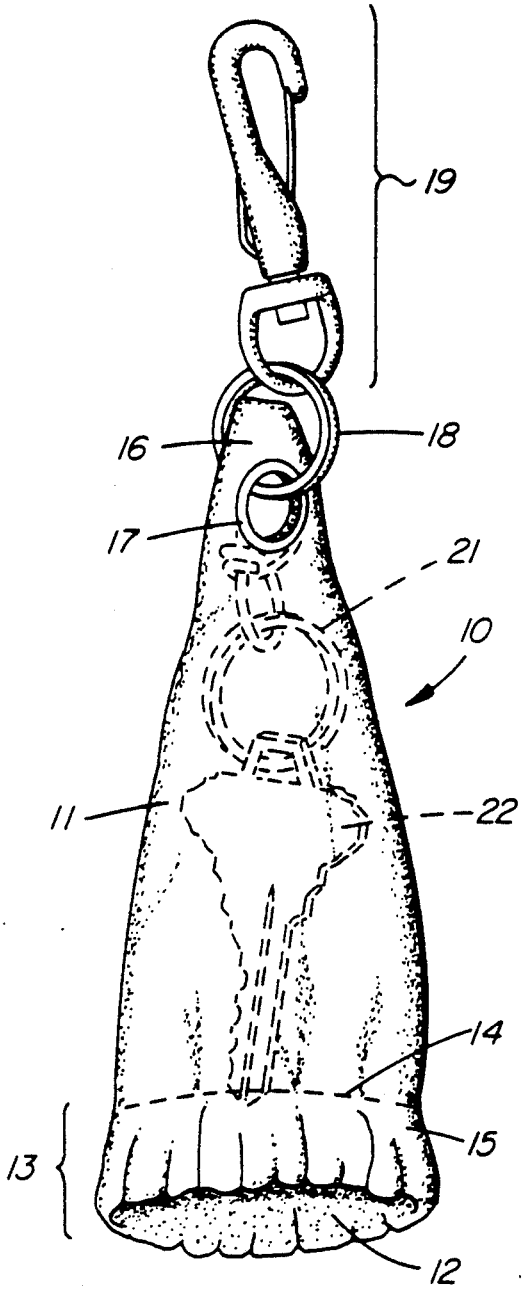
FIG. 1 is a general view of the key case in its normal orientation.
Figure 2:
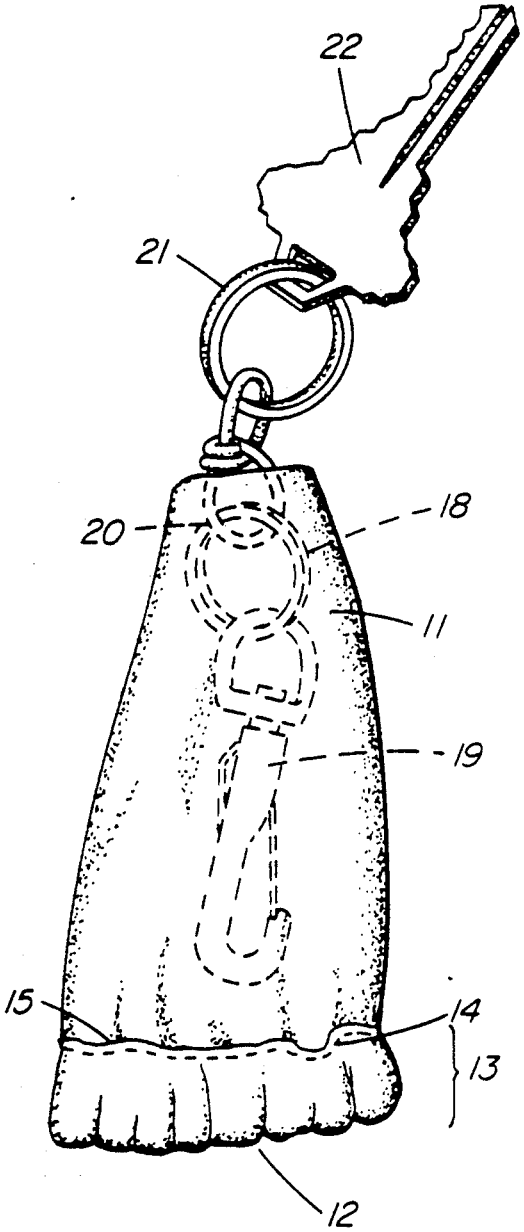
FIG. 2 is a general view of the key case of FIG. 1 in its "inside-out" orientation.

DESCRIPTION OF PREFERRED EMBODIMENTS (i) Description of FIGS. 1 and 2.

As seen in the drawings, the key case 10 includes a sac 11 formed of a thin leather of the thickness known as #1 leather. As described in the text-book "How to Sew Leather," Suede Fare. Revised edition by Phyllis W. Schwebke and Margaret B. Krohn, The Bruce Publishing Company New York, these are no exact standards or methods for grading leather since it is done by "sight and feel" developed through training and experience. Leathers may be graded 1, 2, 3, 4 and so forth according to a thickness as depicted below:

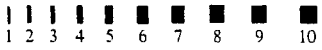

The leather may be calf, pig, deer, chamois, etc. The open end 12 of the cone-shaped sac is provided with a pressure foot 13 formed of a resilient member, e.g., a flat, synthetic elastomeric fibre 14 sewn into a lower hem 15, e.g., by silk thread.

As the closed end 16 of the sac 11 is a metal eyelet 17. Attached to the exterior of the metal eyelet 17 is a ring 18, to which is attached a spring jaw "J" clamp 19.

As seen in FIG. 2, the eyelet 17 has firmly secured to it on the interior of the sac 11 a chain link 20. The chain link 20 in turn holds an internal ring 21 on which is secured one or more keys 22.

OPERATION OF THE INVENTION

In use, the sac is turned "inside-out" and the keys are placed on the interior ring. Then the sac is turned "right-side-out", so that the keys are completely held within the sac. Access to the keys is only available by positively opening the pressure foot and inverting the key sac to allow the keys to drop out. For maximum advantage not more than eight keys should be attached to the interior ring.

This invention therefore has the unique feature that it conforms to the shape of the keys, an advantage over the molded plastic cases of the prior art which do not so conform.

In addition, since access to the keys is obtained by expansion of an elastic pressure foot, there is no chance of breaking the key case with continued flexing of a plastic material. In addition, such case cannot open accidentally since the sac must be positively inverted to gain access to the keys.

Finally, the combination of the chain link and the metal eyelet provides a very secure base for securement of the keys thereto.

CONCLUSION

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. A key case comprising:

a) a sac formed of thin, pliant, reversible material and having a wide, open end and a narrow closed end;

b) an elastic pressure foot at said open end of said sac, said elastic pressure foot being formed by a resilient member sewn into a lower hem at said wide, open end of said sac;

(c) a metal eyelet at said closed end of said sac; and d) a fixed length, non-extendable chain link secured to said eyelet within the interior of said sac;

whereby keys may be secured to said link, and may be disposed completely within said sac, or may be exposed out of said sac for access by turning said sac inside out.

2. The key case of claim 1 which is in the shape of cone, with said elastic pressure foot being at said wide, open end, and with said metal eyelet being at said narrow, closed end.

3. The key case of claim 2 which is made of soft leather of thickness designated as #1 leather.

4. The key case of claim 3 wherein said leather is calf, pig, deer or chamois.

5. The key case of claim 2 including a clasp secured to the eyelet at the exterior of the sac.

6. The key case of claim 5 where said clasp is secured to said eyelet by means of a ring.

7. The key case of claim 2 wherein said keys are secured to said chain link by means of a ring.

8. The key sac of claim 1 wherein said resilient member is a flat, synthetic elastomeric fibre.

9. The key sac of claim 1 wherein said resilient member is flat, synthetic elastomeric fibre and wherein said resilient member is sewn by means of a silk thread.

* * * * *